US011287193B2

(12) United States Patent
Lee et al.

(10) Patent No.: US 11,287,193 B2
(45) Date of Patent: Mar. 29, 2022

(54) REFRIGERATOR

(71) Applicant: LG ELECTRONICS INC., Seoul (KR)

(72) Inventors: Woosung Lee, Seoul (KR); Jihun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 420 days.

(21) Appl. No.: 16/295,572

(22) Filed: Mar. 7, 2019

(65) Prior Publication Data

US 2019/0285355 A1 Sep. 19, 2019

(30) Foreign Application Priority Data

Mar. 13, 2018 (KR) ..... 10-2018-0029205

(51) Int. Cl.
*F28D 15/02* (2006.01)
*F25B 21/02* (2006.01)
(Continued)

(52) U.S. Cl.
CPC ..... *F28D 15/0275* (2013.01); *F25B 21/02* (2013.01); *F25D 17/02* (2013.01);
(Continued)

(58) Field of Classification Search
CPC .... F28D 15/0275; F28D 15/04; F25D 17/062; F25D 17/02; F25D 23/003; F25D 23/006;
(Continued)

(56) References Cited

U.S. PATENT DOCUMENTS 5,501,076 A * 3/1996 Sharp, III ..... F25B 21/02 62/3.2
6,351,951 B1 * 3/2002 Guo ..... F25B 21/02 62/3.2
(Continued)

FOREIGN PATENT DOCUMENTS

CN 203943523 11/2014
CN 203943523 U * 11/2014
(Continued)

OTHER PUBLICATIONS

Chavan et al., Thermoelectric Refrigeration System Running on Solar Energy,Apr. 2015, (IJRRCME), vol. 2, Issue 1, pp. (140-148) (Year: 2015).*
(Continued)

*Primary Examiner* — Emmanuel E Duke
(74) *Attorney, Agent, or Firm* — Fish & Richardson P.C.

(57) ABSTRACT

A refrigerator may include an inner casing having a storage chamber defined therein; and a thermoelectric module including a thermoelectric element for cooling the storage chamber, a cooling sink in contact with one surface of thermoelectric element, and a heat sink contacting the other surface of thermoelectric element, wherein the heat sink includes: a heat dissipation fin including a stack of a plurality of fins; a heat dissipation plate coupled to the heat dissipation fin; a heat dissipation pipe for connecting the heat dissipation plate to the heat dissipation fin, wherein the heat dissipation pipe is arranged to pass through the heat dissipation fin.

19 Claims, 16 Drawing Sheets

(51) Int. Cl.

| | |
|---|---|
| ***F25D 17/02*** | (2006.01) |
| ***F25D 23/00*** | (2006.01) |
| ***F25D 17/06*** | (2006.01) |
| ***F28D 15/04*** | (2006.01) |
| ***F28F 1/32*** | (2006.01) |

(52) U.S. Cl.
CPC ..... *F25D 17/062* (2013.01); *F25D 23/003* (2013.01); *F25D 23/006* (2013.01); *F28D 15/04* (2013.01); *F28F 1/32* (2013.01); *F25B 2321/023* (2013.01); *F25B 2321/025* (2013.01); *F25B 2321/0211* (2013.01); *F25B 2321/0252* (2013.01); *F25D 2323/0021* (2013.01); *F28F 2250/08* (2013.01)

(58) Field of Classification Search
CPC ..... F28F 1/32; F28F 2250/08; F25B 21/02; F25B 2321/025; F25B 2321/0211; F25B 2321/023; F25B 2321/0252; F25B 2321/0021
See application file for complete search history.

(56) References Cited

U.S. PATENT DOCUMENTS

| | | | | |
|---|---|---|---|---|
| 7,918,092 | B2 | 4/2011 | Lin et al. | |
| 2005/0257532 | A1* | 11/2005 | Ikeda | F25B 21/02 62/3.7 |
| 2007/0051498 | A1* | 3/2007 | Xia | H01L 23/427 165/100 |
| 2012/0063092 | A1 | 3/2012 | Lee | |
| 2013/0291564 | A1* | 11/2013 | Ghoshal | F28F 1/325 62/3.6 |
| 2016/0003503 | A1* | 1/2016 | Novisoff | F25B 21/02 62/3.3 |
| 2018/0112895 | A1* | 4/2018 | Choi | F25B 21/02 |

FOREIGN PATENT DOCUMENTS

| | | |
|---|---|---|
| JP | H09113058 | 5/1997 |
| JP | 3343286 | 11/2002 |
| JP | 2017028066 | 2/2017 |
| KR | 20100133209 | 12/2010 |
| KR | 20130048474 | 5/2013 |
| KR | 10-1323876 | 10/2013 |

OTHER PUBLICATIONS

Extended European Search Report in European Application No. 19157115.7, dated Jul. 19, 2019, 7 pages.
Korean Office Action in Korean Appln. No. 10-2018-0029205, dated Oct. 28, 2021, 13 pages (with English translation).

* cited by examiner

REFRIGERATOR

CROSS-REFERENCE TO RELATED APPLICATION

This application is based on and claims the benefit of priority to Korean Patent Application No. 10-2018-0029205, filed on Mar. 13, 2018, in the Korean Intellectual Property Office, the disclosure of which is incorporated herein in its entirety by reference.

BACKGROUND

1. Technical Field

The present disclosure relates to a refrigerator.

2. Description of the Related Art

Generally, a refrigerator is a household appliance that can store objects, such as food, in a low-temperature state in the storage chamber of a cabinet. Because the storage chamber is enclosed by an insulating wall, the interior of the storage chamber may be maintained at a temperature lower than the external temperature.

Depending on the temperature zone of the storage chamber, the storage chamber may be divided into a refrigerating chamber or freezing chamber. The user may store the food in the freezing room or the refrigerating room depending on the type and condition of the food.

The refrigerator may be provided in a built-in type together with other appliances in the kitchen. In this case, the appearance design of the refrigerator is configured to match the kitchen furniture.

In recent years, depending on the various needs of the user, the refrigerator is placed in a living room or a room, not a kitchen. In other words, the installation position of the refrigerator is various.

As the location of the refrigerator varies, the appearance of the refrigerator is configured so that the appearance of the refrigerator goes well with the furniture in the space to install the refrigerator.

Korean Patent No. 10-1323876 discloses a cooling package with a thermoelectric element, and a refrigerator employing the same.

SUMMARY

The present embodiment provides a refrigerator that improves heat dissipation performance of a heat sink of a cooling device.

In addition, the present embodiment provides a refrigerator in which it is easy to assemble between a heat dissipation plate and a heat dissipation fin of a heat sink.

In one aspect, a refrigerator may include an inner casing having a storage chamber defined therein; and a thermoelectric module including a thermoelectric element for cooling the storage chamber, a cooling sink in contact with one surface of thermoelectric element, and a heat sink contacting the other surface of thermoelectric element, wherein the heat sink includes: a heat dissipation fin including a stack of a plurality of fins; a heat dissipation plate coupled to the heat dissipation fin; a heat dissipation pipe for connecting the heat dissipation plate to the heat dissipation fin, wherein the heat dissipation pipe is arranged to pass through the heat dissipation fin.

DETAILED DESCRIPTIONS

Figure 1:
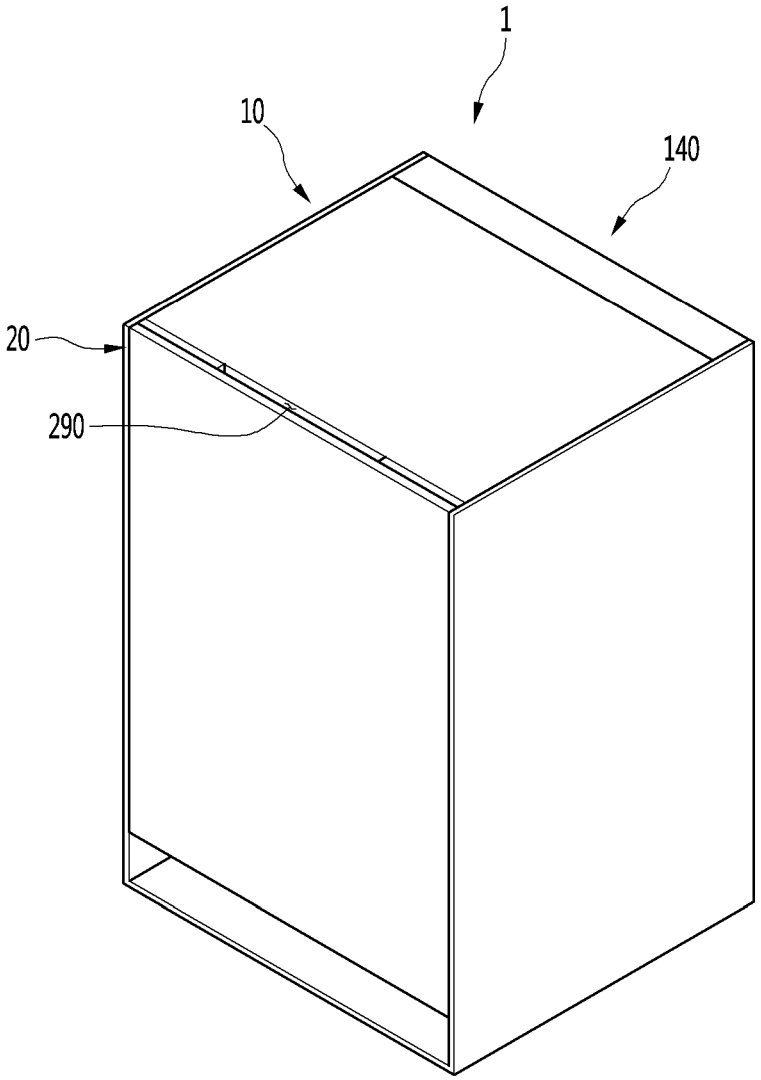
FIG. 1 is a perspective view of a refrigerator according to one embodiment of the present disclosure.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
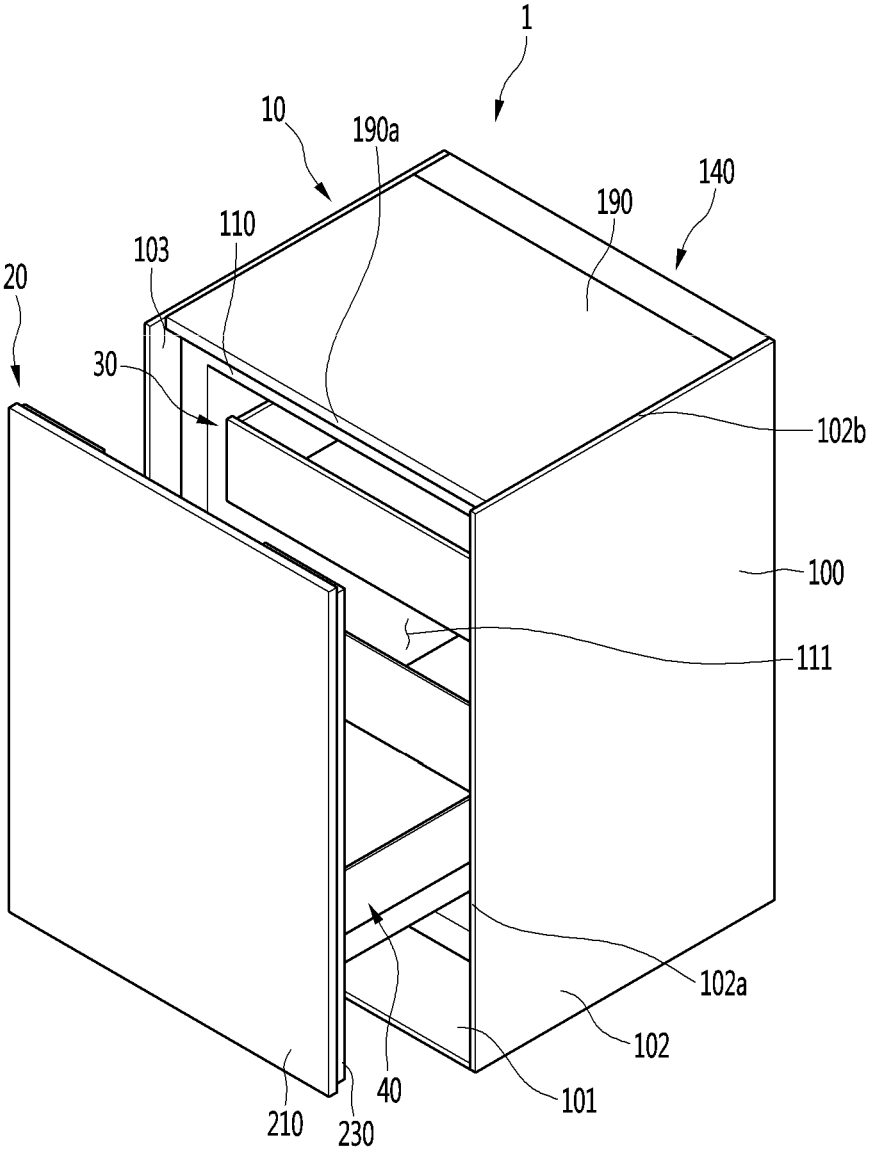
FIG. 2 is a perspective view showing a door being opened in FIG. 1.
Figure 3:
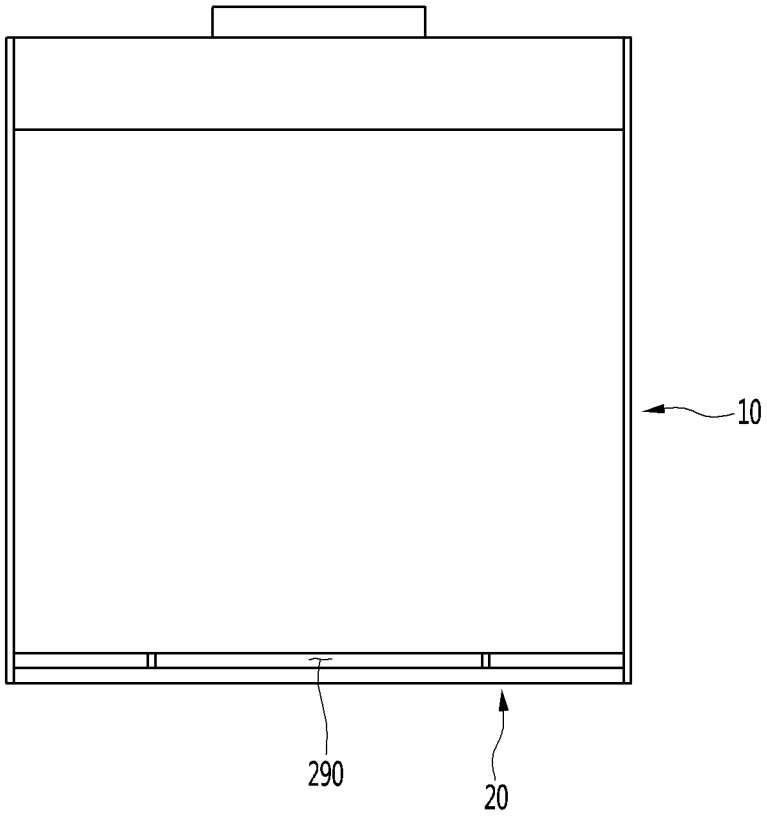
FIG. 3 is a plan view of the refrigerator of FIG. 1.

FIG. 1 is a perspective view of a refrigerator according to one embodiment of the present disclosure. FIG. 2 is a perspective view showing a door being opened in FIG. 1. FIG. 3 is a plan view of the refrigerator of FIG. 1.

Referring to FIGS. 1 to 3, a refrigerator 1 according to one embodiment of the present disclosure may include a cabinet 10 having a storage chamber 111, a door 20, which opens and closes the storage chamber 111, and connected to the cabinet 10.

The cabinet 10 may include the inner casing 110 forming the storage chamber 111, and an outer casing 100 surrounding the inner casing 110.

The outer casing 100 may be formed of a metal material. For example, the outer casing 100 may be formed of aluminum Al. The outer casing 100 may be formed by bending a plate at least twice. Alternatively, the outer casing 100 may be formed by joining a plurality of metal plates.

In one example, the outer casing 100 may include a pair of side panels 102 and 103.

The inner casing 110 may be directly or indirectly fixed to the outer casing 100 with the inner casing 110 being positioned between the pair of side panels 102 and 103.

A front end 102*a* of each of the pair of side panels 102 and 103 may be located more forwards than the front surface of the inner casing 110. The horizontal width of the door 20 may be equal to or less than the distance between the side panels 102 and 103.

Thus, a space in which the door 20 may be located may be defined between the pair of side panels 102 and 103.

In one example, the door 20 may be located between the pair of side panels 102 and 103 with the storage chamber 111 being closed by the door.

In this connection, the front surface of the door 20 may be coplanar with a front end 102*a* of each of the side panels 102 and 103 such that a step between the door 20 and the cabinet 10 may not occur when the storage chamber 111 is closed by the door.

That is, the front surface of the door 20 and a front end 102*a* of each of the side panels 102 and 103 may together define the appearance of the front surface of the refrigerator 1.

The door 20 may include a front panel 210 and a door liner 230 coupled to a rear surface of the front panel 210.

The front panel 210 may be formed of a wood material. However, the present disclosure is not limited thereto.

In one example, the front panel 210 and the door liner 230 may be engaged with each other by fasteners such as screws. The front panel 210 and the door liner 230 form a foam space therebetween. When the foam liquid is filled in the foam space, a thermal-insulating material may be formed between the front panel 210 and the door liner 230.

The door 20 may have a gripping space 290 in which a user's hand may be inserted so that the user can catch the door 20 to open the door 20.

In one example, the gripping space 290 may be formed by partially recessing an upper portion of the door liner 230 downwardly.

While the door 20 closes the storage chamber 111, the gripping space 290 may be located between the front panel 210 and the cabinet 10. Thus, while the door 20 closes the storage chamber 111, the user may open the door 20 by inserting a hand into the gripping space 290 and then pulling the door 20.

In the present embodiment, since while the door 20 is closed, a structure such as a handle does not protrude outward, there is an advantage that the beauty of refrigerator 1 is improved.

The height of the refrigerator 1 may be lower than a typical adult height. The present disclosure may not be limited thereto. The lower the capacity of the refrigerator 1, the lower the height of the refrigerator 1.

As in the present embodiment, when there is a gripping space 290 within the top of the door 20, the following advantage is achieved: Even though the height of the refrigerator 1 is low, the user can easily open the door 20 while the user is standing or sitting.

In one embodiment, the top end 102*b* of each of the pair of side panels 102 and 103 may be higher than the top of the inner casing 110.

Therefore, a space may be formed above the inner casing 110. A cabinet cover 190 may be located in the space. The cabinet cover 190 may form a top appearance of the cabinet 10. That is, the cabinet cover 190 forms a top appearance of the refrigerator 1.

The cabinet cover 190 may be secured directly to the inner casing 110 or to the middle plate 150 surrounding the inner casing 110.

While the cabinet cover 190 covers the inner casing 110, the cabinet cover 190 may be located between the pair of side panels 102 and 103.

In one embodiment, in order to avoid a step between the cabinet cover 190 and the cabinet 10, a top surface of the cabinet cover 190 may be located on the same plane or the same height as the top end 102*b* of each of the side panels 102 and 103.

In one example, the cabinet cover 190 may be formed of wood material. The present disclosure is not so limited.

That is, the front panel 210 and the cabinet cover 190 may be formed of the same material.

In the present embodiment, the front panel 210 of the door 20 and the cabinet cover 190 are both formed of a wood material. Thus, there is an advantage that the aesthetics can be improved due to the material identity between the door 20 and the cabinet cover 190 while the door 20 is closed.

Further, when the height of the refrigerator 1 is low, the user can visually check the cabinet cover 190. In this connection, since the cabinet cover 190 is made of the wood material, this has the advantage of not only improving the basic aesthetics but also achieving aesthetic harmony with the surrounding furniture where the refrigerator 1 is positioned.

In one example, the refrigerator 1 of the present embodiment may be implemented as a refrigerator that can be used as a table (hereinafter, a table type refrigerator).

A refrigerator that can be used as a table may also serve as a table function in addition to the storage function of foods. Unlike conventional refrigerators, which are often found in the kitchen, a refrigerator, which can be used as a table, may be placed next to the bedroom bed and may be used. In the present embodiment, since the cabinet cover 190 and the front panel 210 are formed of wood material, the appearance of the refrigerator may be in harmony with the surrounding furniture when the refrigerator 1 is placed next to the bedroom.

In one example, for the convenience of the user, the height of the table type refrigerator is preferably similar to the height of the bed. The height of the table type refrigerator may be smaller than the height of a conventional refrigerator and thus the refrigerator may be formed compactly.

A front surface 190*a* of the cabinet cover 190 may be located more forwards than the front surface of the inner casing 110. Thus, while the door 20 closes the storage chamber 111, the cabinet cover 190 may cover a portion of the door liner 230 from above.

The refrigerator 1 may further include one or more drawer assemblies 30 and 40 received in the storage chamber 111.

A plurality of drawer assemblies 30 and 40 may be provided in the storage chamber 111 for efficient storage space.

The multiple drawer assemblies 30 and 40 may include an upper drawer assembly 30 and a lower drawer assembly 40. In some cases, the upper drawer assembly 30 may be omitted.

The door 20 may open and close the storage chamber 111 while sliding in a forward and backward direction.

In the present embodiment, even when the refrigerator 1 is placed in a narrow space such as a kitchen, living room, or room, the user has the advantage that the door 20 can be opened without interfering with the surrounding structure since the door 20 opens and closes the storage chamber 111 in the sliding manner.

In order that the door 20 is slid in and out, the refrigerator 1 may also include a rail assembly (not shown).

The rail assembly (not shown) may be connected to the door 20 on one side of the rail assembly, and to the lower drawer assembly 40 on the other side of the rail assembly.

Figure 4:
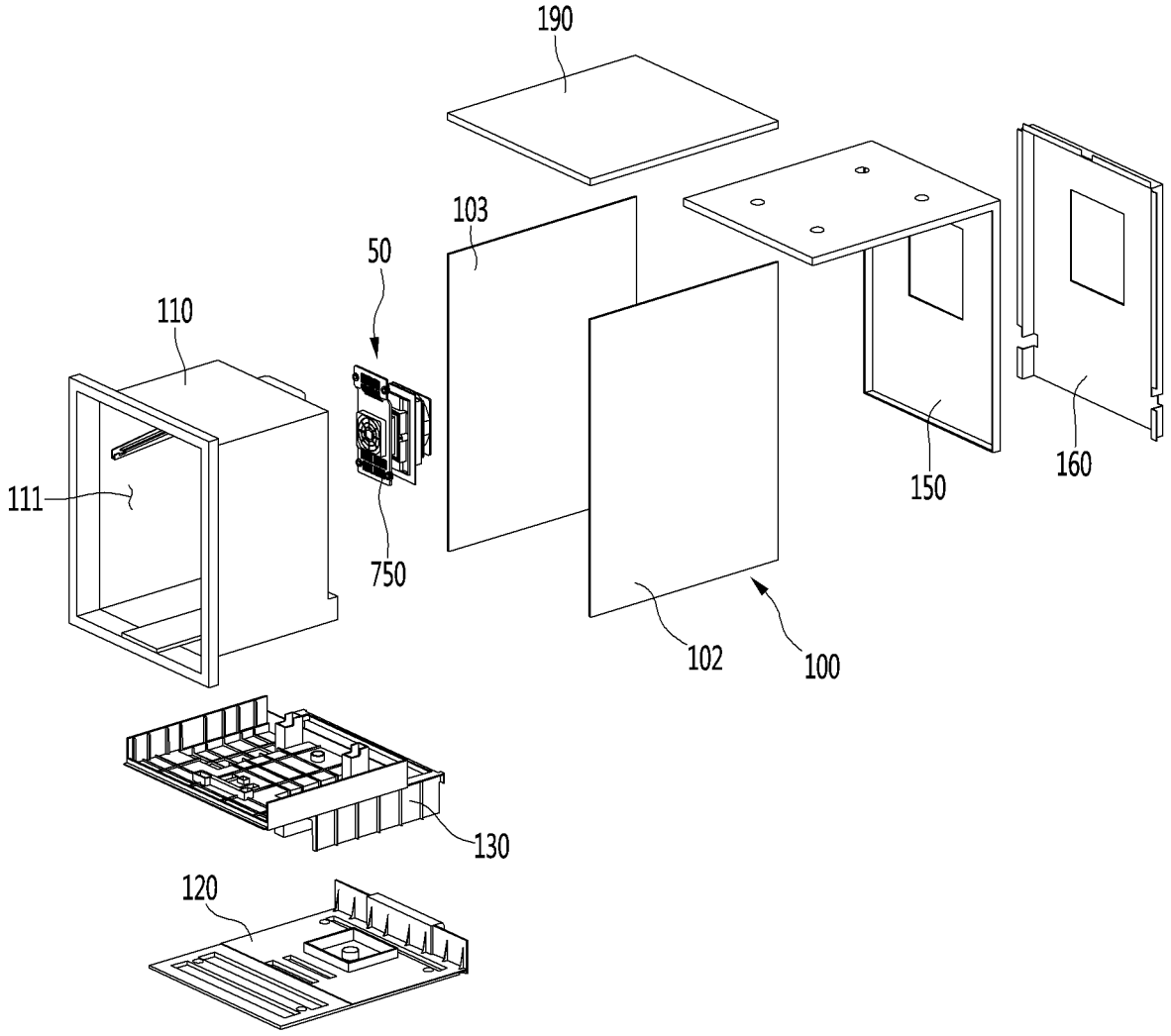
FIG. 4 is an exploded perspective view of a cabinet according to one embodiment of the present disclosure.

FIG. 4 is an exploded perspective view of the cabinet according to one embodiment of the present disclosure.

Referring to FIGS. 1 to 4, a cabinet 10 according to one embodiment of the present disclosure may include an outer casing 100, an inner casing 110, and a cabinet cover 190.

The outer casing 100 may include a pair of side panels 102 and 103. The pair of side panels 102, 102 may form the side appearance of the refrigerator 1.

The outer casing 100 may further include a rear panel 160 that forms the rear surface appearance of the refrigerator 1.

Thus, the appearance of the refrigerator 1 except the door 20 may be formed by the side panels 102 and 103, the cabinet cover 190 and the rear panel 160.

The cabinet 10 may further include a casing supporter 130 supporting the inner casing 110 and a base 120 coupled to a bottom of the casing supporter 130.

The cabinet 10 may also include a middle plate 150. The middle plate, together with the inner casing 110, forms a foam space. The middle plate 150 may cover the top and rear surfaces of the inner casing 110 at a spaced apart position from the inner casing 110.

A display unit 140 may be coupled to at least one of the middle plate 150 or the side panels 102 and 103.

The cabinet 10 may further include a cooling device 50 for cooling the storage chamber 111.

Figure 9:
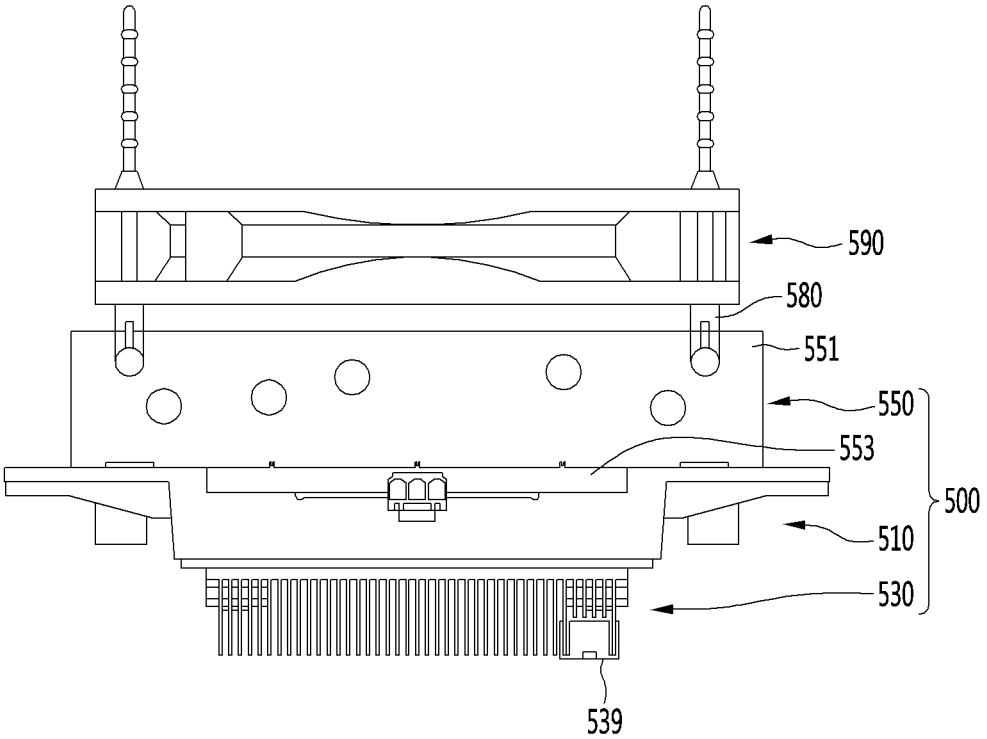
FIG. 9 is a top view of a cooling device of FIG. 8.

The cooling device 50 may include a thermoelectric module (see 500 in FIG. 9), a cooling fan 750 and a heat dissipation fan (see 590 in FIG. 9). The adoption of thermoelectric elements may reduce the size of the refrigerator.

The foam space may be formed by the inner casing 110, the side panels 102 and 103, the casing supporter 130 and the middle plate 150. A foam liquid may be filled in the foam space to form a thermal-insulating material.

Figure 5:
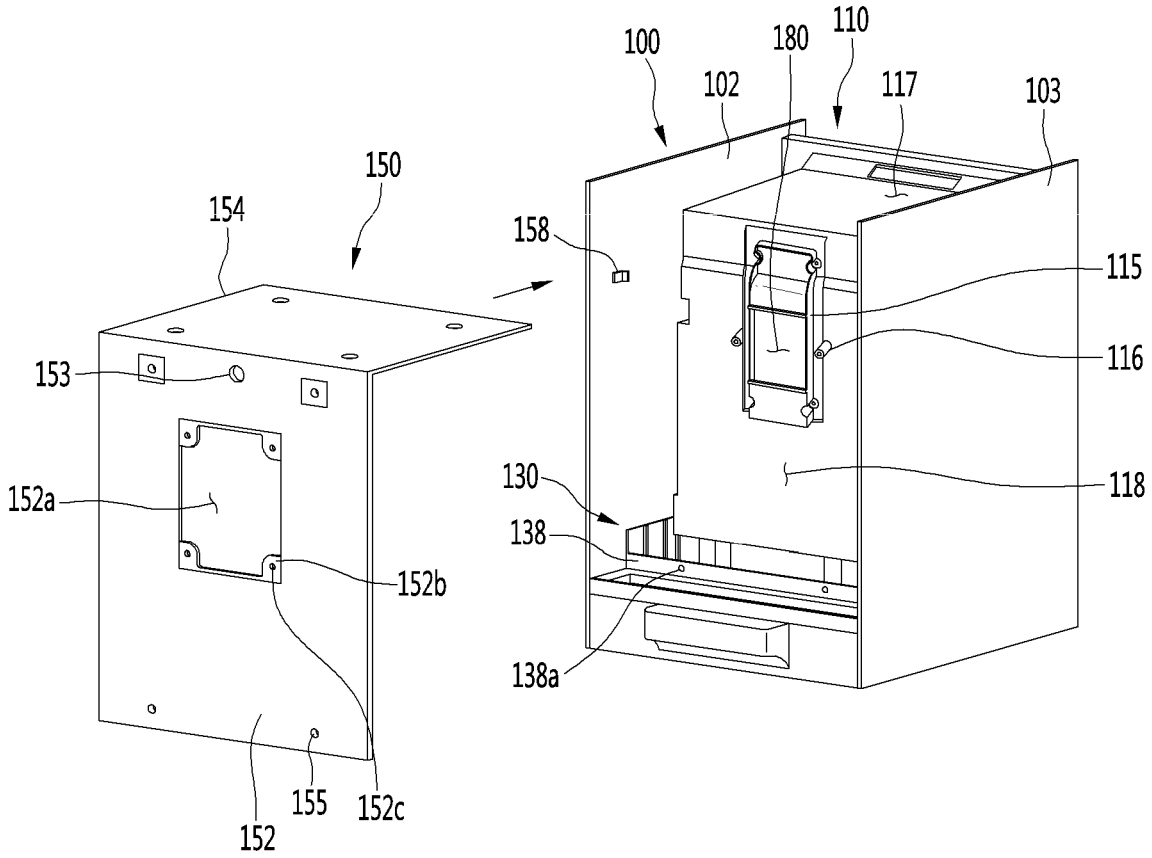
FIG. 5 shows a state before a middle plate is assembled according to one embodiment of the present disclosure.
Figure 6:
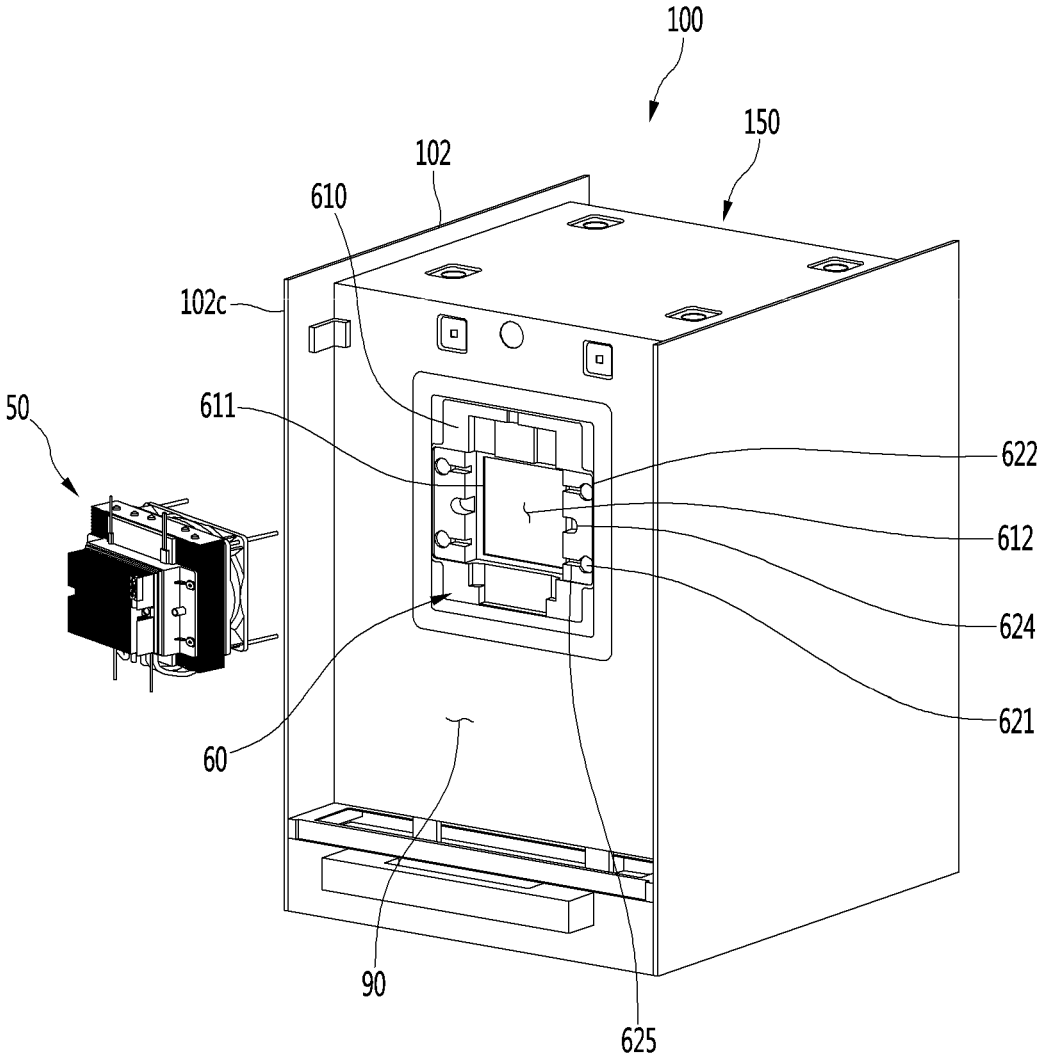
FIG. 6 shows a state in which the middle plate has been assembled according to one embodiment of the present disclosure.
Figure 7:
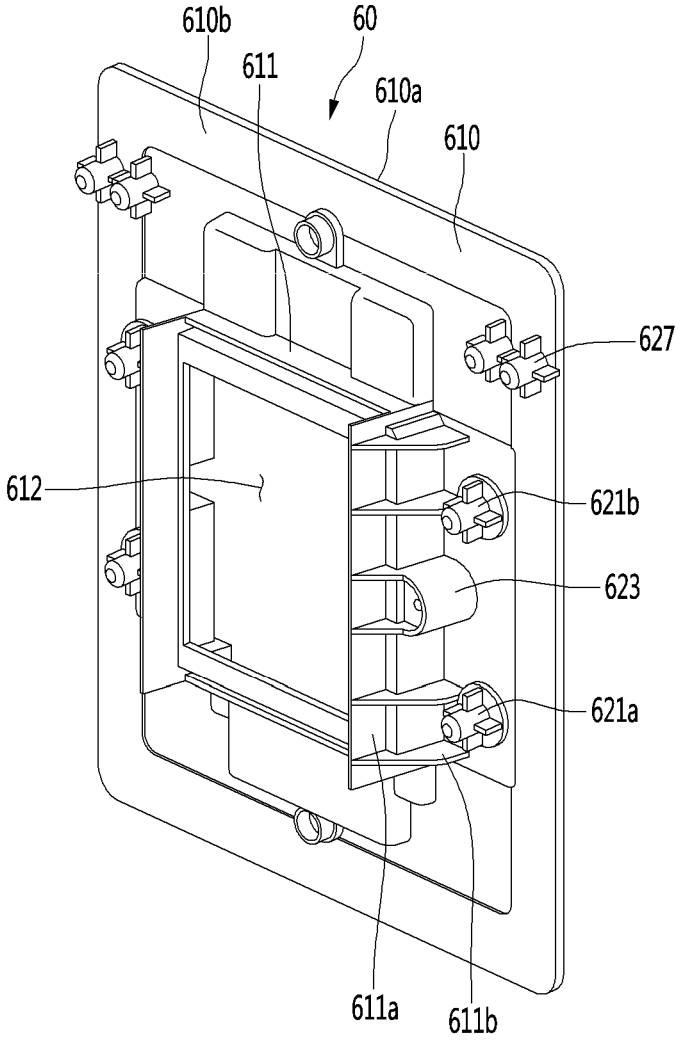
FIG. 7 is a perspective view of an installation bracket according to one embodiment of the present disclosure.

FIG. 5 shows a state before a middle plate is assembled according to one embodiment of the present disclosure. FIG. 6 shows a state in which the middle plate has been assembled according to one embodiment of the present disclosure. FIG. 7 is a perspective view of an installation bracket according to one embodiment of the present disclosure.

Referring to FIGS. 5 to 7, the middle plate 150 may cover the inner casing 110 at the rear of the inner casing 110.

The middle plate 150 may include a rear plate 152 covering a rear surface of the inner casing 110 and an upper plate 154 covering a top surface of the inner casing 110.

The upper plate 154 may extend horizontally from the top of the rear plate 152. Accordingly, the middle plate 150 may be formed in the form of an inverted L shape.

The upper plate 154 may be seated on a top end of the front surface of the inner casing 110. In one example, the upper plate 154 may be attached to the top end of front surface of the inner casing 110 by adhesive means.

While the upper plate 154 is seated on the top end of the front surface of the inner casing 110, the upper plate 154 may be spaced apart from a top surface of the inner casing 110. Thus, a foam space 117 may be defined between the upper plate 154 and a top surface of the inner casing 110.

The rear plate 152 may be coupled to the casing supporter 130. The casing supporter 130 may have a plate engagement rib 138.

In each of the plate engagement ribs 138 and the rear plate 152, engagement holes 138*a* and 155 for bolt engagement may be formed.

While the rear plate 152 is in contact with the rear surface of the plate engagement rib 138, the rear plate 152 may be engaged with the plate engagement rib 138 by bolts.

In this connection, while an installation bracket 60 is engaged with the rear plate 152 between the rear plate 152 and the rear surface of the inner casing 110, the middle plate 150 may be assembled.

The rear plate 152 may be spaced apart from the rear surface of the inner casing 110. Thus, a foam space 118 may be defined between the rear plate 152 and the rear surface of the inner casing 110.

A fixing bracket 158 may be fixed to the rear of the rear plate 152. The fixing bracket 158 may be secured to each of the side panels 102 and 103. Thus, the fixing bracket 158 not only fixes the rear plate 152 to the side panels 102 and 103, but also prevents deformation of the rear plate 152 during the filling of the foam liquid.

The rear plate 152 may be provided with an inlet 153 for injection of the foam liquid therethrough. The inlet 153 may be blocked by unillustrated packing.

The rear plate 152 may further include a through-hole 152*a* through which the cooling device 50 passes.

In a state in which the assembly of the middle plate 150 is completed, a top surface of the upper plate 154 may be positioned lower than the top end 102*b* of the respective side panels 102 and 103. Thus, above the upper plate 154, there may be a space where the cabinet cover 190 may be located.

Furthermore, in a state in which the assembly of the middle plate 150 is completed, the rear surface of the rear plate 152 may be spaced forwards from the rear end 102*c* of the respective side panels 102 and 103. Thus, behind the rear plate 152, there may be a space through which the air for heat dissipation of the cooling device 50 may flow.

The installation bracket 60 may include a plate-type installation plate 610. The installation plate 610 may be engaged with the rear plate 152 via the fastener such as a screw.

The installation plate 610 may include the first surface 610*a* and a second surface 610*b* facing the first surface 610*a*.

An engagement extension 152*b* for engagement of the installation bracket 60 may be formed in the through-hole 152*a* of the rear plate 152. An engagement hole 152*c* may be formed in the extension 152*b*.

The first surface 610*a* of the installation plate 610 may contact the extension 152*b*.

The installation plate 610 may include a receiving portion 611 for receiving a portion of the cooling device 50. In one example, the receiving portion 611 may be formed by a portion of the first surface 610*a* being recessed toward the second surface 610*b*. A portion of the receiving portion 611 may protrude from the second surface 610*b*.

In the bottom of the receiving portion 611, an opening 612 through which the cooling sink 530 to be described later passes may be formed.

The receiving portion 611 includes walls 611*a* surrounding the cooling sink 530 passing through the opening 612. At least one of the walls 611*a* may be formed to have a reinforcing rib 611*b*.

In the second surface 610*b* of the installation plate 610, an engagement boss 627 for engagement with the middle plate 150 may be formed. The engagement boss 627 may protrude from the second surface 610*b* in a direction away from the first surface 610*a*.

Moreover, in the second surface 610*b* of the installation plate 610, a plurality of the first engagement portions 621*a* and 621*b* for engagement with the cooling device 50 may be formed. The plurality of first engagement portions 621*a* and 621*b* may protrude from the second surface 610*b* in a direction away from the first surface 610*a*.

In one example, the plurality of the first engagement portions 621*a* and 621*b* may be disposed on both opposite sides of the opening 612, such that the engagement thereof with the cooling device 50 may be firm. In one example, the first engagement portions 621*a* and 621*b* may be disposed at the opposite sides of the opening 612 and may be spaced from each other in a vertical direction.

In the first surface 610*a* of the installation plate 610 and in the regions corresponding to the plurality of first engagement portions 621*a* and 621*b*, first protrusion receiving grooves 621 and 622 may be formed to accommodate first engagement protrusions 514 and 515 of the cooling device 50 to be described later respectively. Once the first engagement protrusions 514 and 515 are received within the first protrusion receiving grooves 621 and 622, the first engagement protrusions 514 and 515 are temporarily fixed. Thus, the screw may be easily engaged with the first engagement protrusions 514 and 515 and the first engagement portions 621*a* and 621*b*.

In the first surface 610*a* of the installation plate 610, a rib receiving groove 625 may be formed. The rib receiving groove 625 communicates the space in the receiving portion 611 with the respective first protrusion receiving grooves 621 and 622.

The installation plate 610 may further include second engagement portions 623 for engagement with the inner casing 110. The second engagement portions 623 may be formed on both opposite sides of the receiving portion 611, respectively.

The second engagement portion 623 may protrude from the second surface 610*b* of the installation plate 610. Further, the inner casing 110 may have a plate engagement boss 116 aligned with the second engagement portion 623. The plate engagement boss 116 may protrude from the rear surface of the inner casing 110.

In order to maximize the coupling between the inner casing 110 and the installation plate 610, the second engagement portion 623 may be positioned a level bisecting the height of the installation plate 610 or adjacent to the level bisecting the height of the installation plate 610.

In one example, the second engagement portion 623 may be located in a region corresponding to a region between a plurality of the first engagement portions 621*a* and 621*b*.

Further, the installation plate 610 may further include a second protrusion receiving groove 624 for receiving the second engagement protrusion 518 of the cooling device 50, which will be described later. The second protrusion receiving groove 624 may be aligned with the second engagement portion 623.

Figure 8:
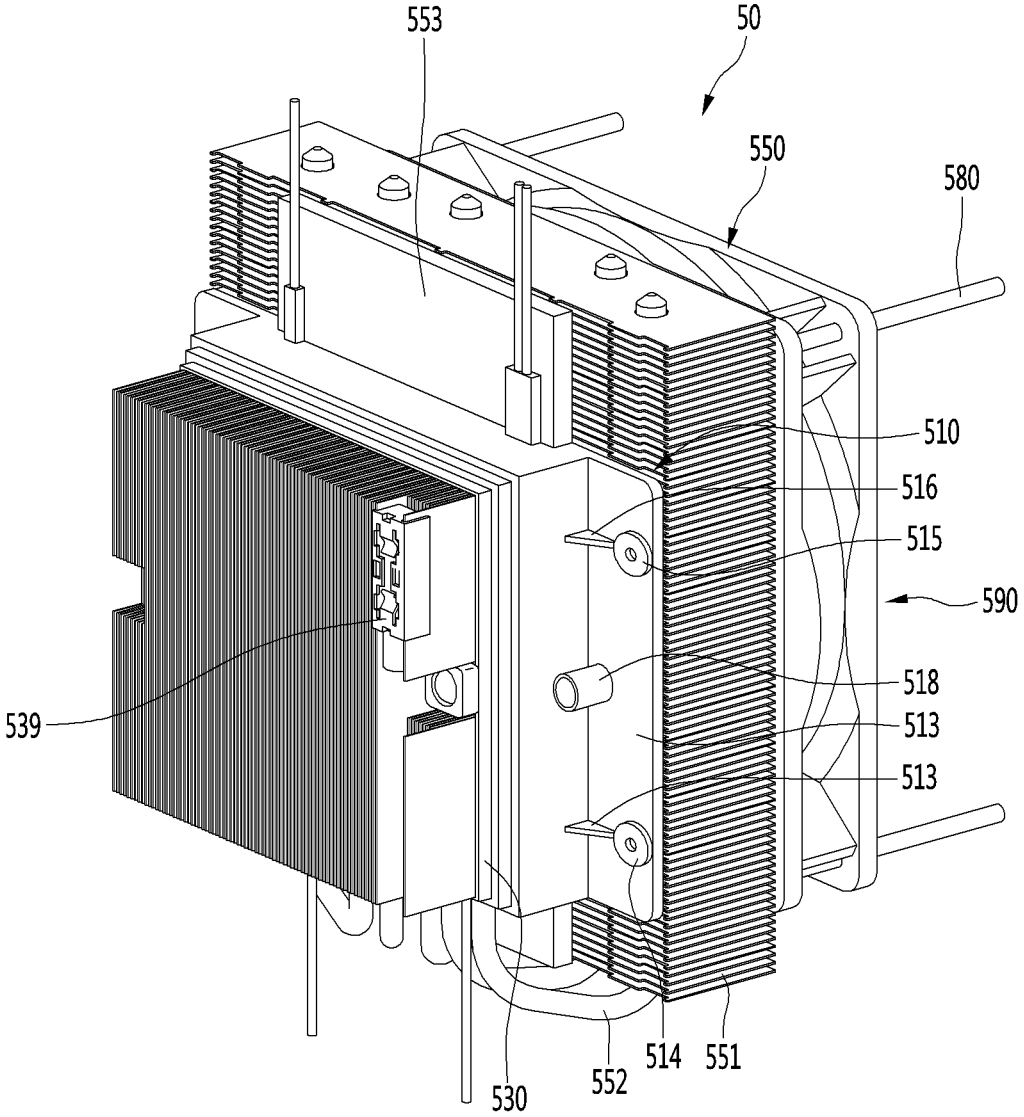
FIG. 8 is a perspective view of a cooling device according to one embodiment of the present disclosure.
Figure 10:
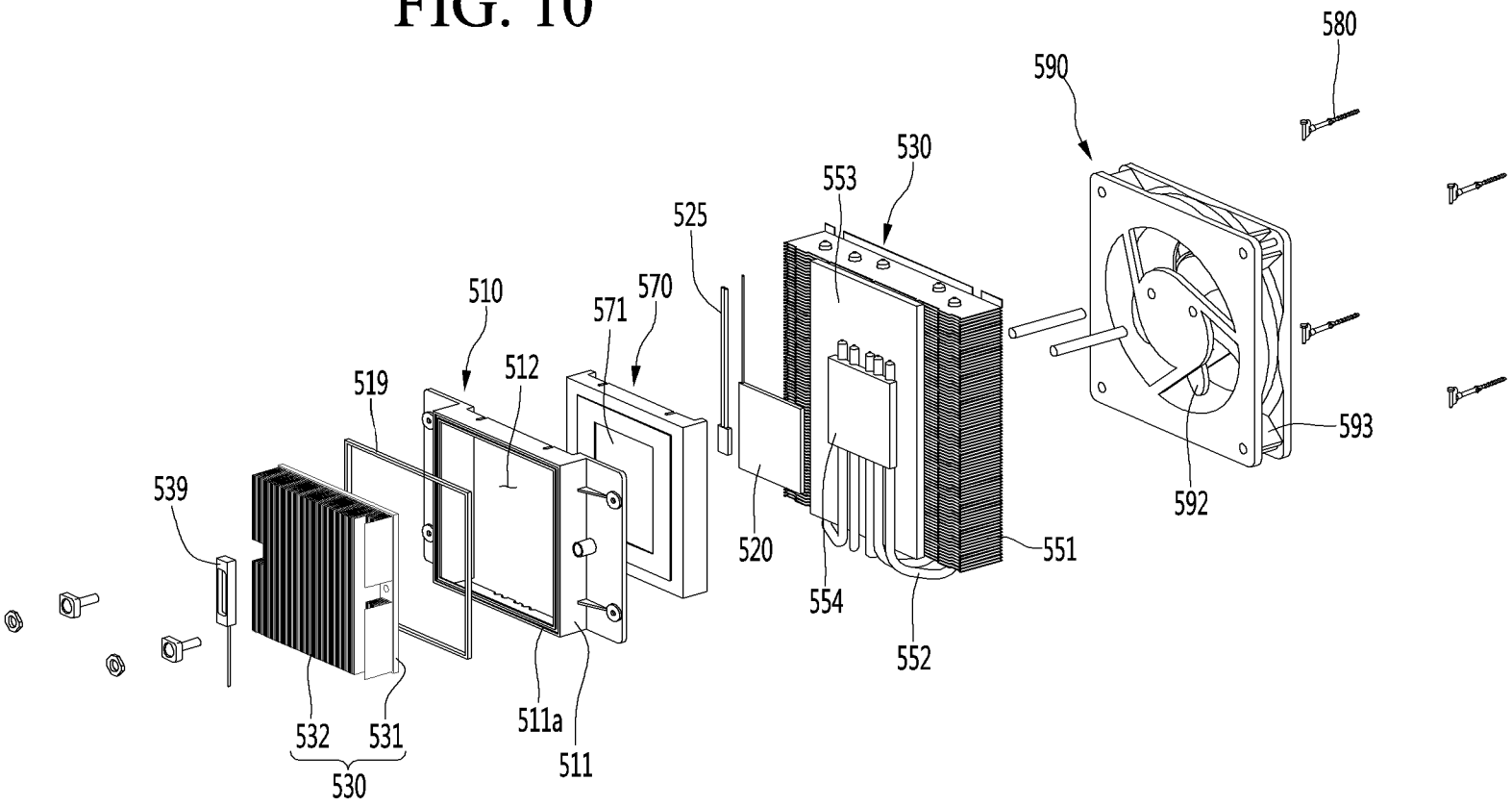
FIG. 10 and FIG. 11 are exploded perspective views of the cooling device of FIG. 8.
Figure 11:
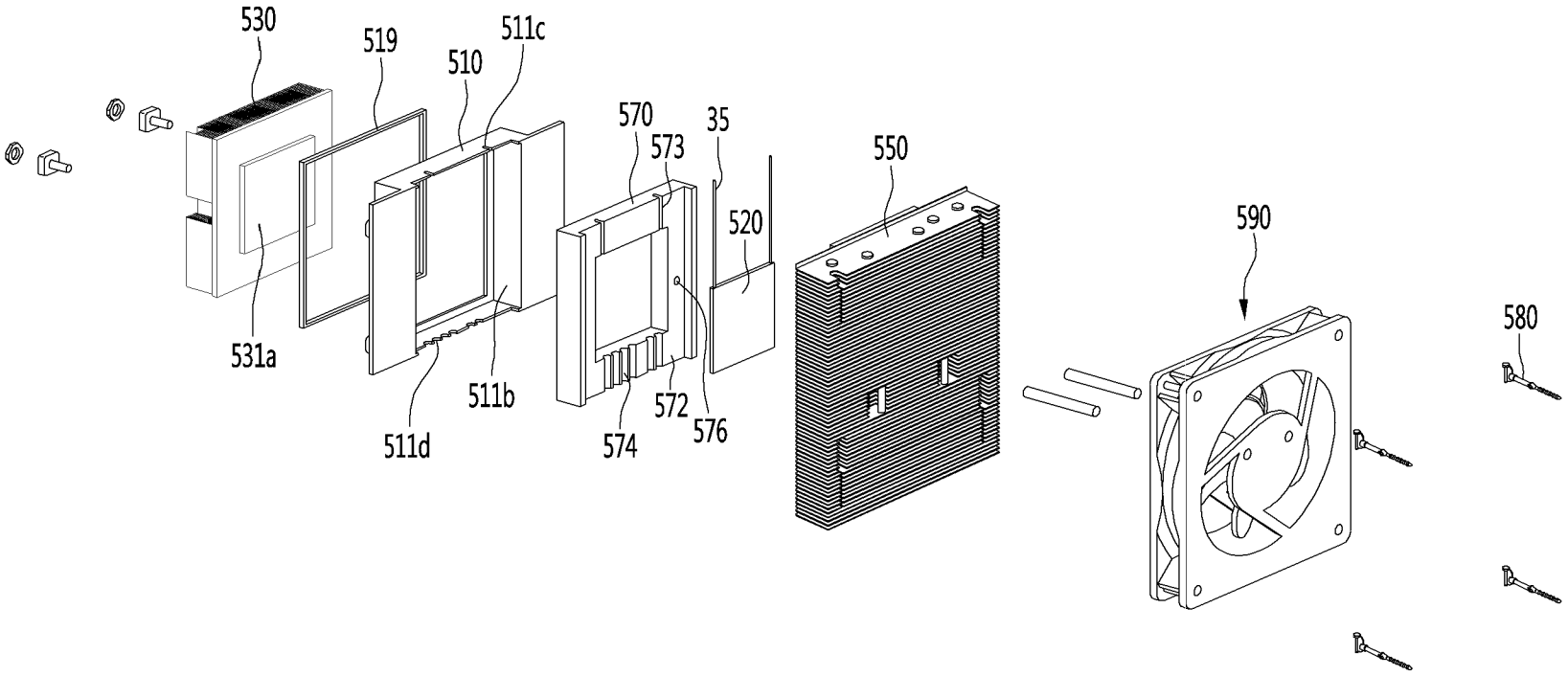
Figure 12:
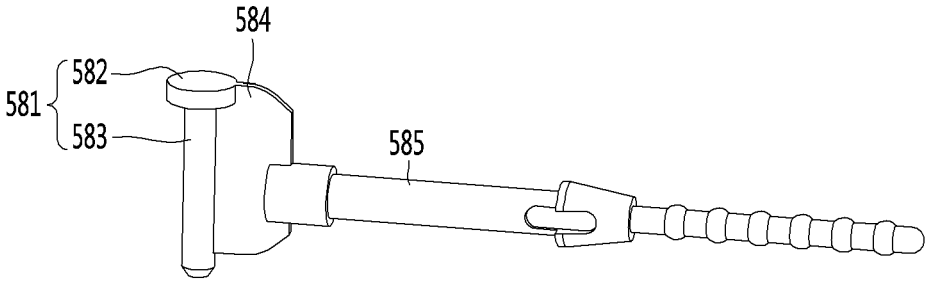
FIG. 12 is a perspective view of a fixing pin according to one embodiment of the present disclosure.

FIG. 8 is a perspective view of a cooling device according to one embodiment of the present disclosure. FIG. 9 is a top view of a cooling device of FIG. 8. FIG. 10 and FIG. 11 are exploded perspective views of the cooling device of FIG. 8. FIG. 12 is a perspective view of a fixing pin according to one embodiment of the present disclosure.

Referring to FIG. 5 and FIG. 8 to FIG. 12, the cooling device 50 may include a thermoelectric module 500. The thermoelectric module 500 may include a thermoelectric element 520, a cooling sink 530, a heat sink 550, and a module frame 510.

The thermoelectric module 500 may utilize the Peltier effect to keep the temperature of the storage chamber 111 low. The thermoelectric module 500 itself is a well-known technology, and thus the details of the operating principle of the module 500 will be omitted.

The cooling device 50 may pass through the middle plate 150 and may be disposed more forwards than the rear panel 160.

The thermoelectric element 520 may include a low-temperature portion and a high-temperature portion. The low-temperature portion and the high-temperature portion may be determined according to the direction of the voltage applied to the thermoelectric element 520. The low-temperature portion of the thermoelectric element 520 may be disposed closer to the inner casing 110 than the high-temperature portion.

The low-temperature portion may contact the cooling sink 530, while the high-temperature portion may contact the heat sink 550. The cooling sink 530 cools the storage chamber 111. In the heat sink 550, heat dissipation may occur.

A fuse 525 may be connected to the thermoelectric element 520. Thus, when an overvoltage is applied to the thermoelectric element 520, the fuse 525 may also block the voltage applied to the thermoelectric element 520.

The cooling device 50 may include a cooling fan 750 for flowing air from the storage chamber 111 to the cooling sink 530 and a heat dissipation fan 590 for flowing external air to the heat sink 550.

The cooling fan 750 may be disposed in front of the cooling sink 530, while the heat dissipation fan 590 may be disposed behind the heat sink 550.

The cooling fan 750 may be positioned to face the cooling sink 530, while the heat dissipation fan 590 may be disposed to face the heat sink 550.

The cooling fan 750 may be disposed within the inner casing 110. The cooling fan 750 may be covered by a fan cover.

The cooling device 50 may further include a defrost sensor 539. The defrost sensor 539 may be disposed on the cooling sink 530.

The cooling device 50 may further include a thermal-insulating member 570 that surrounds the thermoelectric element 520. The thermoelectric element 520 may be located within the thermal-insulating member 570.

The thermal-insulating member 570 may be provided with an element mounting hole 571 opened in the front-rear direction. The thermoelectric element 520 may be located within the element mounting hole 571.

The front-rear direction thickness of the thermal-insulating member 570 may be larger than the thickness of the thermoelectric element 571.

The thermal-insulating member 570 may prevent the heat of the thermoelectric element 520 from being conducted around the thermoelectric element 520, thereby enhancing the cooling efficiency of the thermoelectric element 520. The perimeter of the thermoelectric element 520 may be covered by the thermal-insulating member 570, so that the heat transmitted from the cooling sink 530 to the heat sink 550 may not spread to the surroundings.

The thermal-insulating member 570 may include a plate receiving groove 572 for receiving the heat dissipation plate 553, which will be described later. The thickness of the thermoelectric module 500 may be reduced when the heat dissipation plate 553 is received in the receiving groove 572 of the plate.

The element mounting hole 571 passes through the plate receiving groove 572.

In the bottom of the plate receiving groove 572, a pipe receiving groove 574 for receiving the heat dissipation pipe 552, which will be described later, may be formed. The pipe receiving groove 574 may extend from the plate receiving groove 572 in a vertical direction. Each pipe receiving groove 574 may be located above and below the element mounting hole 571, respectively.

In addition, an wire receiving groove 573 may be formed in the bottom of the receiving groove 572 to receive an electrical wire connected to the thermoelectric element 520. The wire receiving groove 573 may extend upwardly from the element mounting hole 571. The wire receiving groove 573 may communicate with the element mounting hole 571. Therefore, even when the thermoelectric element 520 is placed in the element mounting hole 571, the electrical wire may extend from the element mounting hole 571 through the wire receiving groove 573 to the outside of the thermal-insulating member 570.

In addition, the thermal-insulating member 570 may further include an engagement hole 576 through which a fastener (see 5519 in FIG. 13) for engagement with the heat dissipation plate 553 may penetrate. In one example, the engagement hole 576 may extend through the plate receiving groove 572.

The cooling sink 530 may be arranged to contact the thermoelectric element 520. The cooling sink 530 may be kept at a low temperature by contacting the low-temperature portion of the thermoelectric element 520.

The cooling sink 530 may include a cooling plate 531 and a cooling fin 532.

The cooling plate 531 may be disposed in contact with the thermoelectric element 520. At least a portion of the cooling plate 531 may be inserted into an element mounting hole 571 formed in the thermal-insulating member 570 to contact the thermoelectric element 520.

In one example, the cooling plate 531 may include a protrusion 531*a* protruding to be inserted into the element mounting hole 571.

The cooling plate 531 may contact the low-temperature portion of the thermoelectric element 520 to conduct cool air to the cooling fin 532.

The cooling fin 532 may be disposed in contact with the cooling plate 531.

The cooling plate 531 may be located between the cooling fin 532 and the thermoelectric element 520. The cooling fin 532 may be located in front of the cooling plate 531.

The cooling fin 532 may be positioned within the storage chamber 111 through the inner casing 110.

The inner casing 110 may include a passage forming portion 115 forming a cooling passage 180. The cooling fin 532 may be located within the cooling passage 180. The cooling fin 532 may also heat-exchange with the air in the cooling passage 180 to cool the air. A plurality of cooling fins 532 may be in contact with the cooling plate 531 to increase the heat exchange area with the air. Each of the plurality of cooling fins 532 may extend in the vertical direction. The plurality of cooling fins 532 may be arranged to be spaced apart from each other in the horizontal direction.

The module frame 510 may include a box-shaped frame body 511.

In the frame body 511, a space 512 may be formed to accommodate the thermal-insulating member 570 or the thermoelectric element 520. Since the thermoelectric element 520 is accommodated in the thermal-insulating member 570, the thermoelectric element 520 may be located within the space 512.

The module frame 510 may be formed of a material that may minimize heat loss due to heat conduction. For example, the module frame 510 may have a nonmetallic material such as plastic. The module frame 510 may prevent the heat of the heat sink 550 from being conducted to the cooling sink 530.

A gasket 519 may be coupled to the front surface of the frame body 511.

The gasket 519 may have an elastic material such as rubber. In one example, the gasket 519 may be formed in a rectangular ring shape, but the present disclosure is not limited thereto. The gasket 519 may also be a sealing member. A gasket groove 511*a* may be formed in the front surface of the frame body 511 to accommodate the gasket 519 therein.

The frame body 511 may be received in the receiving portion 611 of the installation plate 610. The frame body 511 may contact a wall 611*a* forming the receiving portion 611. Further, the gasket 519 coupled to the frame body 511 may be in contact with the bottom of the receiving portion 611.

Accordingly, the gasket 519 may prevent the heat dissipation passage 90 and the cooling passage 180 formed between the middle plate 150 and the rear panel 160 from communicating with each other.

In the frame body 511, a plate receiving groove 511*b* for receiving the heat dissipation plate 553 may be formed. The plate receiving groove 511*b* may be formed in the rear surface of the frame body 511.

In addition, in the frame body 511, an wire receiving groove 511*c* may be formed to receive an electrical wire connected to the thermoelectric element 520.

Once the thermal-insulating member 570 is received within the frame body 511, the wire receiving groove 511*c* of the frame body 511 may be aligned with the wire receiving groove 573 of the thermal-insulating member 570.

Furthermore, in the frame body 511, a pipe receiving groove 511*d* for receiving the heat dissipation pipe 552 may be additionally formed.

Once the thermal-insulating member 570 is received within the frame body 511, the pipe receiving groove 511*d* of the frame body 511 may be aligned with the pipe receiving groove 574 of the thermal-insulating member 570.

The module frame 510 may further include an engagement plate 513 extending from the frame body 511.

In one example, the engagement plates 513 may extend from both opposite sides of the frame body 511, respectively. The engagement plate 513 has a configuration for being coupled with the installation bracket 60.

The engagement plate 513 may extend from a position adjacent to the rear surface of the frame body 511.

In one example, the engagement plate 513 may have a plurality of the first engagement protrusions 514 and 515 for engagement with the plurality of first engagement portions 621*a* and 621*b*. The plurality of first engagement protrusions 514 and 515 may be spaced apart in a vertical direction.

In addition, the engagement plate 513 may further include a second engagement protrusion 518 for engagement with the second engagement portion 623.

To maximize the coupling between the inner casing 110 and the module frame 510 and the installation bracket 60, the second engagement protrusion 518 may be positioned a level bisecting the height of the module frame 510 or adjacent to the level bisecting the height of the module frame 51.

The fastener may engage the plate engagement boss 116, the second engagement portion 623, and the second engagement protrusion 518.

In order that the engagement force to be transmitted to the frame body 511 is minimized during the engagement of the fastener with the plurality of first engagement protrusions 514 and 515, the plurality of first engagement protrusions 514 and 515 may be located on the side end of the engagement plate 513 at a position farthest from the frame body 511 in the horizontal direction.

When an excessive engagement force is generated in the process of the fastener being engaged with the plurality of first engagement protrusions 514 and 515, the engagement plate 513 may be deformed. Thus, the deformation force of the engagement plate 513 may be transmitted to the frame body 511.

Then, the position of the frame body 511 relative to the bottom of the receiving portion 611 is changed. Thus, a portion of the gasket 519 may be spaced apart from the bottom of the receiving portion 611. In this case, there is a problem that the cooling passage 180 and the heat dissipation passage 90 are communicated with each other such that the cold air of the storage chamber 111 leaks to the heat dissipation passage 90.

Thus, in the present embodiment, it may be configured such that the plurality of first engagement protrusions 514 and 515 may be located on the side end of the engagement plate 513 at a position farthest from the frame body 511 in the horizontal direction.

In addition, in the present embodiment, in order that the deformation of the engagement plate 513 relative to the frame body 511 is minimized in the process of engaging the fastener with the plurality of first engagement protrusions 514 and 515, a connection rib 516 for connecting the frame body 511 and each of the first engagement protrusions 514 and 515 may protrude from the engagement plate 513.

The fastener engaged with the second engagement protrusion 518 is configured to maintain the gasket 519 of the frame body 511 to be in contact with the bottom of the receiving portion 611.

However, the frame body 511 should be prevented from being deformed via the engagement force of the second engagement protrusion 518.

To this end, the number of the second engagement protrusions 518 may be smaller than the number of the first engagement protrusions 514 and 515.

The second engagement protrusions 518 may be spaced apart in the vertical and horizontal directions from the first engagement protrusions 514 and 515, respectively.

In one example, the second engagement protrusion 518 may be located in a region corresponding to a region between a pair of the first engagement protrusions 514 and 515.

The horizontal distance of the second engagement protrusion 518 and the frame body 511 may be smaller than the horizontal distance of the first engagement protrusion 514 and 515 and the frame body 511. The present disclosure is not limited to the above-described configuration.

Further, the second engagement protrusion 518 may be connected to the frame body 511 via one or more of the connection ribs (not shown). However, since the second engagement protrusion 518 is located close to the frame body 511, a plurality of the connection ribs (not shown) may connect the frame body 511 and the second engagement protrusion 518 to prevent effectively deformation of the frame body 511.

In order to prevent the frame body 511 from being deformed by the engagement force of the second engagement protrusion 518, the protrusion length of the second engagement protrusion 518 may be longer than the protrusion length of the first engagement protrusion 514 and 515.

The heat sink 550 may include the heat dissipation plate 553, the heat dissipation pipe 552, and the heat dissipation fin 551.

In one example, the heat dissipation fin 551 may include a stack of the plurality of fins. The fins are spaced in the vertical direction.

The heat dissipation plate 553 is formed in the form of a thin plate. The heat dissipation plate 553 contacts the heat dissipation fin 551.

The vertical length of the heat dissipation plate 553 may be the same or similar to the stack height of the plurality of fins. The present disclosure is not limited to the above-described configuration.

The heat sink 530 may further include an element contacting plate 554 for contacting the thermoelectric element 520. The area of the element contacting plate 554 may be smaller than the area of the heat dissipation plate 553.

The element contacting plate 554 may be formed to have approximately the same size as the thermoelectric element 520. The element contacting plate 554 may be positioned within the element mounting hole 571 formed in the thermal-insulating member 570.

As the heat transfer area increases, the thermal conductivity increases. Thus, ideally, the element contacting plate 554 and the thermoelectric element 520 are in surface contact with each other. In addition, a fine gap may be formed between the element contacting plate 554 and the thermoelectric element 520. Thereby, a thermal grease or a thermal compound may be filled in the gap to increase the thermal conductivity.

The heat dissipation plate 553 may be in contact with the high-temperature portion of the thermoelectric element 520 to conduct heat to the heat dissipation pipe 552 and the plurality of heat dissipation fins 551.

The heat dissipation fin 551 may be located behind the middle plate 150.

The heat dissipation fin 551 may be located between the middle plate 150 and the rear panel 160. The heat dissipation fin 551 may heat dissipate by exchanging heat with the external air sucked by the heat dissipation fan 590.

The heat dissipation fan 590 may be disposed to face the heat sink 550. The heat dissipation fan 590 may blow the outside air into the heat sink 550.

The heat dissipation fan 590 may include a fan 592 and a shroud 593 surrounding the outside of the fan 592. In one example, the fan 592 may be an axial flow fan.

The heat dissipation fan 590 may be spaced apart from the heat sink 550. Thereby, the flow resistance of the air blown by the heat dissipation fan 590 may be minimized, and, further, the heat exchange efficiency at the heat sink 550 may be increased.

The heat dissipation fan 590 may be secured to the heat sink 550 by fixing pins 580. In one example, the fixing pins 580 may be coupled to the plurality of fins.

The fixing pins 580 may penetrate the shroud 593. While the shroud 593 is combined with the fixing pins 580, the shroud 593 may be separated from the heat dissipation fin 551.

The fixing pins 580 may be formed of a low thermal conductivity material such as rubber or silicone. Thus, since the heat dissipation fan 590 is coupled to the fixing pins 580, the vibration generated in the rotation process of the fan 592 may be minimally transferred to the heat sink 550.

Figure 13:
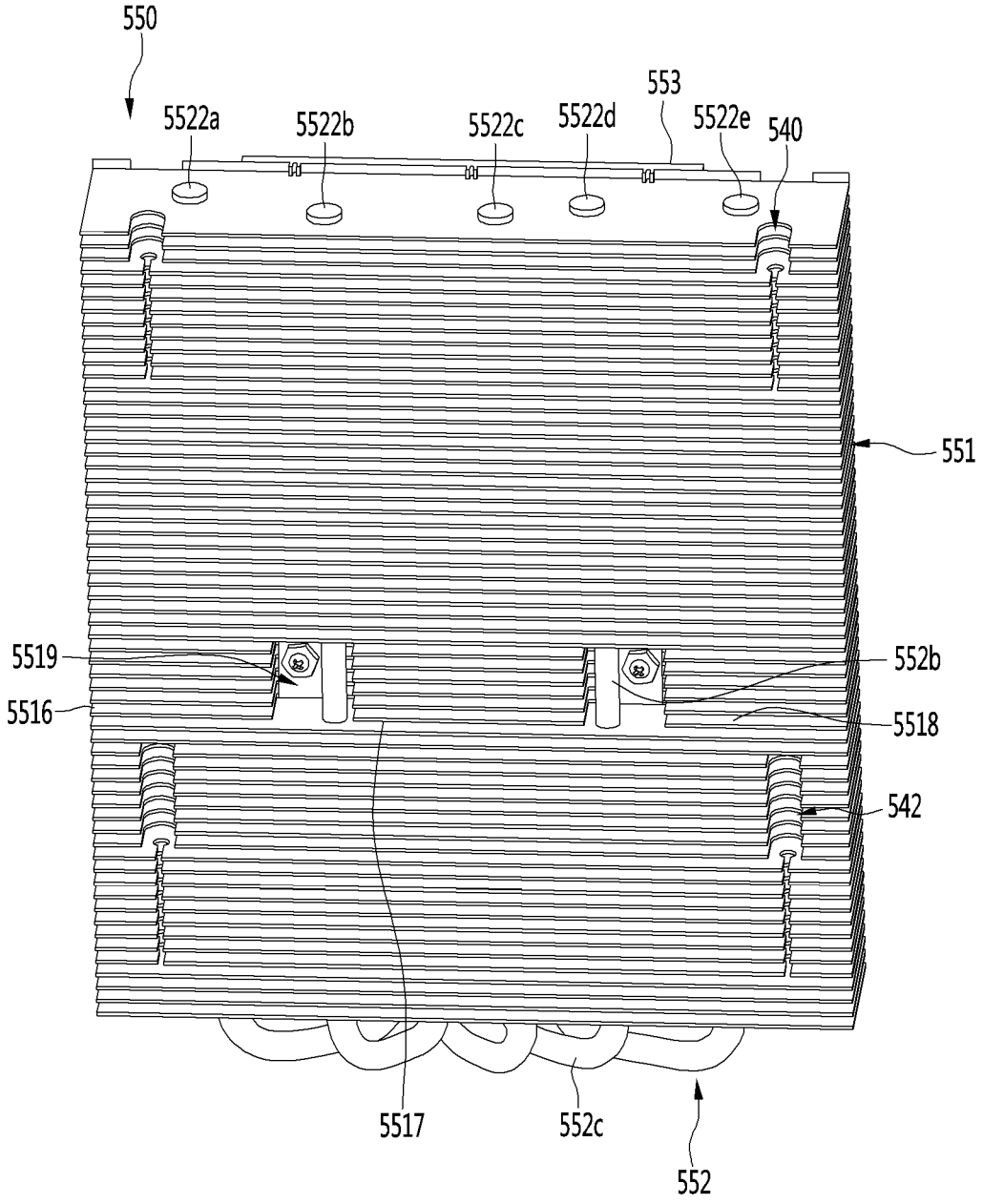
FIGS. 13 and 14 show a perspective view of a heat dissipation pipe coupled to a heat dissipation fin, according to one embodiment of the present disclosure.

The fixing pins 580 may include a head 581 to couple to the fin-engagement portion (see 540 and 542 in FIG. 13).

The head 581 may include a first portion 582 and a second portion 583. The second portion 583 is formed smaller in diameter than the first portion 582. The second portion 583 extends downward from the first portion 582.

In addition, the fixing pins 580 may include an extension 584 extending in a horizontal direction from the head 581 and a fixing portion 585 extending from the extension 584.

The thickness of the extension 584 may be smaller than the diameter of the second portion 583.

Figure 14:
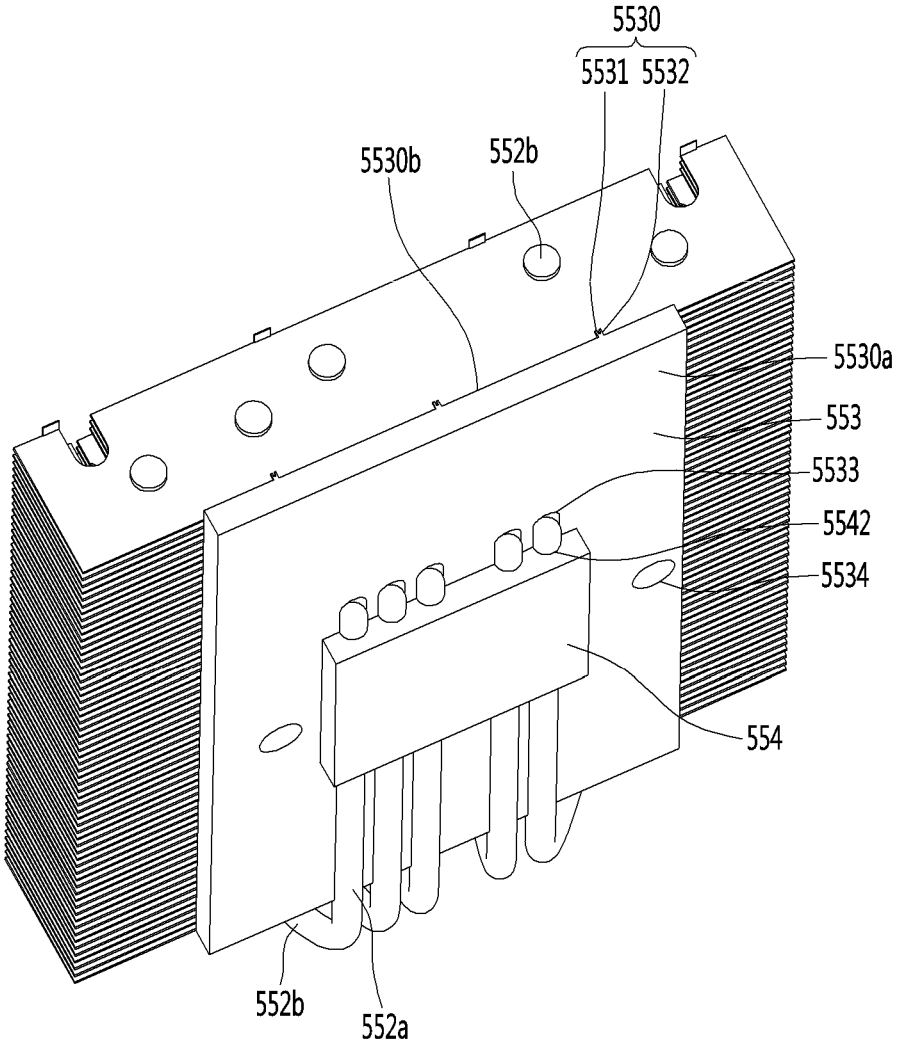
Figure 15:
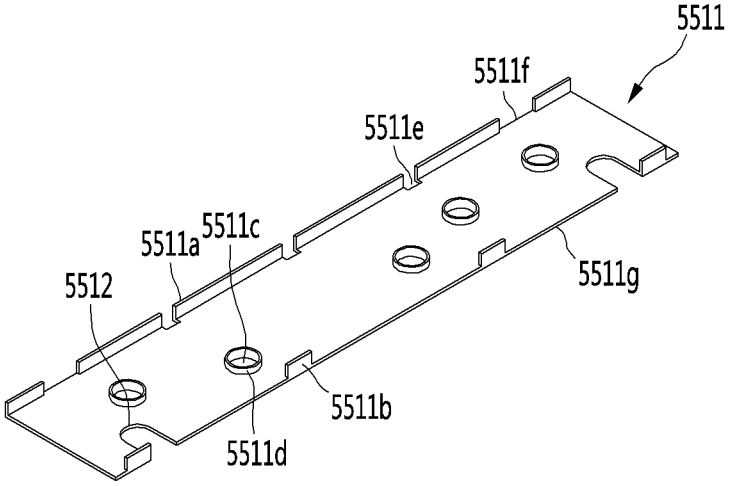
FIG. 15 is a perspective view of a first fin in the heat dissipation fin.
Figure 16:
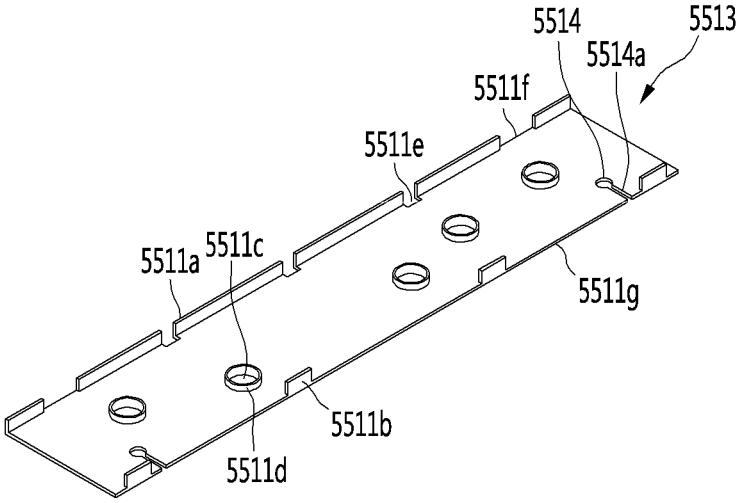
FIG. 16 is a perspective view of a second fin in the heat dissipation fin.
Figure 17:
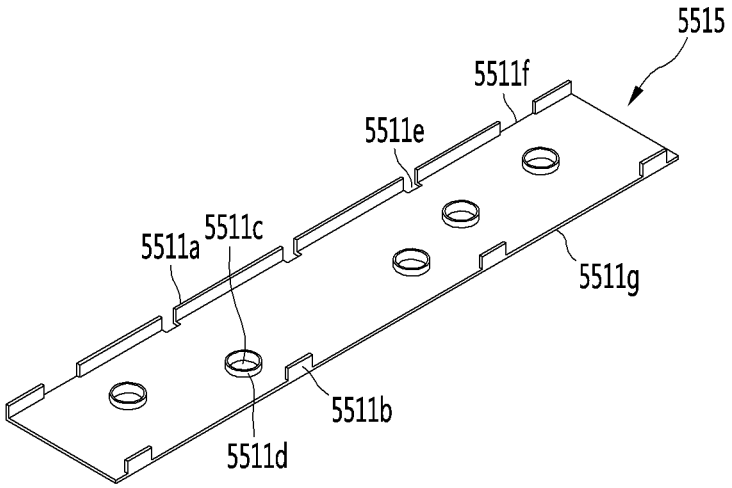
FIG. 17 is a perspective view of a third pin in the heat dissipation fin.

FIGS. 13 and 14 show a perspective view of a heat dissipation pipe coupled to a heat dissipation fin, according to one embodiment of the present disclosure. FIG. 15 is a perspective view of a first fin in the heat dissipation fin. FIG. 16 is a perspective view of a second fin in the heat dissipation fin. FIG. 17 is a perspective view of a third pin in the heat dissipation fin.

Referring to FIGS. 13 to 17, the heat dissipation fin 551 may include a plurality of fins stacked in a vertical direction.

Some of the plurality of fins may be in contact with each other, while others thereof may be separated from each other. Thus, air may then flow along a spaced space between two adjacent fins.

The heat dissipation pipe 552 may be a heat pipe with a heat-transfer fluid contained therein.

A portion of the heat dissipation pipe 552 may be seated in the pipe-seated groove 5553 formed in the heat dissipation plate 550, while the other portion thereof may be arranged to pass through the heat dissipation fin 551. Thus, the heat dissipation pipe 552 may be disposed approximately in the form of "U".

In order to improve the heat dissipation performance, a plurality of the heat dissipation pipes 552 may be arranged to penetrate the heat dissipation fin 551. While the plurality of heat dissipation pipes 552 pass through the heat dissipation fin 551, the plurality of heat dissipation pipes 552 may be spaced in a horizontal direction from each other.

In one example, the heat dissipation pipe 552 may include a first pipe 552*a* in contact with the heat dissipation plate 553, a second pipe 552*b* passing through the heat dissipation fin 551, and a third pipe 552*a* connecting the first pipe 552*a* and the second pipe 552*b*.

In the first pipe 552*a* of the heat dissipation pipe 552, which contacts the heat dissipation plate 553, the internal heat-transfer fluid may evaporate therein. In the second pipe 552*b* in contact with the heat dissipation fin 551, the heat-transfer fluid may be condensed therein.

The heat-transfer fluid may circulate in the heat dissipation pipe 552 by density difference and/or gravity. Thus, the heat-transfer fluid may conduct heat from the heat dissipation plate 553 to the heat dissipation fin 551.

The first pipe 552*a* and the second pipe 552*b* may extend in a straight line in the vertical direction. While the first pipe 552*a* and the second pipe 552*b* are spaced in the horizontal direction from each other, the third pipe 552*c* may connect the first pipe 552*a* and the second pipe 552*b*.

In this connection, in order that the heat-transfer fluid may flow smoothly between the first pipe 552*a* and the second pipe 552*b*, the third pipe 552*c* may be rounded or curved. In one example, the third pipe 552*c* may connect the bottom of the first pipe 552*a* to the bottom of the second pipe 552*b*.

In one example, the heat dissipation pipe 552 includes a wick portion having pores in a copper-made tube. A predetermined space may be formed inside the wick portion.

The wick portion may have the same copper material as the tube. The present disclosure is not limited to the above-described configuration. In one example, powders of copper may be cured by heating to form the porous wick portion.

The heat-transfer fluid at the vapor state flows into the low-temperature region (second pipe 552*b*) in the space. The fluid condenses in the low-temperature region. When the heat-transfer fluid condenses, the fluid may be absorbed into the wick portion. As a result, the fluid flows along the wick portion to the high-temperature region (first pipe 552*a*). As a result, the fluid evaporates again in the high-temperature region and flows into the space. Then, the vapor-state heat-transfer fluid flowing into the space flows back into the low-temperature region again.

The thickness of the heat dissipation plate 553 may be preferably thin in terms of heat conduction. The heat dissipation pipe 552 preferably has a diameter of at least a predetermined size in order to secure a space for condensation and evaporation of the heat-transfer fluid therein.

Thus, the diameter of the heat dissipation pipe 552 may be greater than the thickness of the heat dissipation plate 553.

In the element contact portion 554, a groove 5542 for receiving the heat dissipation pipe 552 may be formed, such that the element contacts portion 554 contacts the heat dissipation plate 553 without interfering with the heat dissipation pipe 552 seated within the heat dissipation plate 553. The first pipe 552*a* may be seated in the groove 5542.

In one embodiment, the heat dissipation plate 553 may include a fin-engagement portion 5530 for coupling with the heat dissipation fin 551. The fin-engagement portion 5530 may be elongated in a first direction (in one example, vertical direction) from the heat dissipation plate 553. In one example, the first direction is the stacking direction of the plurality of fins.

In order to achieve firm bond between the heat dissipation plate 553 and the heat dissipation fin 551, a plurality of fins coupling portions 5530 may be formed on the heat dissipation plate 553 while the plurality of fins coupling portions 5530 may be spaced in a second direction (in one example, horizontal direction) perpendicular to the first direction from each other.

The pipe-seated groove 5533 may be formed in the first surface 5530*a* of the heat dissipation plate 553. The fin-engagement portion 5530 may be formed on the second surface 5530*b* opposite to the first surface 5530*a*. Further, the element contacting plate 554 contacts the first surface 5530*a* of the heat dissipation plate 553. Since as described above, the groove 5542 is formed in the element contacting plate 554, the element contacting plate 554 may be in face-contact with the first surface 5530*a* of the heat dissipation plate 553.

The fin-engagement portion 5530 may include a first protrusion 5531, which is elongated in the first direction, and a second protrusion 5532 spaced from the first protrusion 5531 in a second direction perpendicular to the first direction. In one example, the first direction may be the vertical direction, while the second direction may be the horizontal direction.

In the heat dissipation fin 551, an engagement groove 5511*e* for coupling the fin-engagement portion 5530 may be formed. In one example, the engagement groove 5511*e* may be formed in some or all of the plurality of fins stacked in the vertical direction.

In this connection, both the first protrusion 5531 and the second protrusion 5532 may be accommodated in a single engagement groove 5511*e*.

The width of the engagement groove 5511*e* may be equal to or smaller than the maximum distance between the first protrusion 5531 and the second protrusion 5532. Thus, the first protrusion 5531 and the second protrusion 5532 may be fit-engaged within the engagement groove 5511*e*. Thus, while the first protrusion 5531 and the second protrusion 5532 are coupled within the engagement groove 5511*e*, the first protrusion 5531 and the second protrusion 5532 may be prevented from easily escaping from the engagement groove 5511*e*.

The heat dissipation plate 553 may further include an engagement hole 5534 through which the fastener (see 5519 in FIG. 13) for engagement with the thermal-insulating member 570 may pass.

The fastener (see 5519 in FIG. 13) may pass through the heat dissipation fin 551 and may be engaged into the engagement hole 5534.

In one embodiment, the heat dissipation fin 551 may further include coupling portions 540 and 542 to couple to the fixing pins 580.

The coupling portions 540 and 542 may be spaced apart from one another in the vertical and horizontal directions. The present disclosure is not limited to the above-described configuration. In one example, four coupling portions 540 and 542 may be arranged adjacent to the four corners of the heat dissipation fin 551.

The heat dissipation fin 551 may include first to third fins 5511, 5513 and 5515, which are distinguished from each other according to the shape of the fin.

The first to third fins 5511, 5513 and 5515 may be commonly formed in a thin plate shape. Each of the first to third fins 5511, 5513 and 5515 may be configured such that a transverse length thereof is longer than a longitudinal length thereof. That is, each fin 5511, 5513 and 5515 may include two parallel short sides and two parallel long sides 5511*f* and 5511*g*.

Each of the first to third fins 5511, 5513 and 5515 may commonly include a pipe through-hole 5511*c*, which the heat dissipation pipe 552 passes through. In one example, the second pipe 552*b* may pass through the pipe through-hole 5511*c*.

Around the pipe through-hole 5511*c* defined in each of the fins 5511, 5513 and 5515, a sleeve 5511*d* may be formed. The sleeve 5511*d* may surround the heat dissipation pipe 552 passing through the pipe through-hole 5511*c*. The sleeve 5511*d* may also be in surface contact with the heat dissipation pipe 552.

Thus, the sleeve 5511*d* may increase the contact area between the heat dissipation pipe 552 and the heat dissipation fin 551 to improve the heat dissipation performance.

The sleeve 5511*d* may also act as a spacer to maintain spacing between the fins stacked in the vertical direction.

The heat dissipation pipe 552 may penetrate the pipe through-hole 5511*c* in the first direction, while the sleeve 5511*d* may protrude in the first direction and around the pipe through-hole 5511*c*.

The sleeves 5511*d* may protrude upwards from the fins 5511, 5513 and 5515, respectively. The present disclosure is not limited to the above-described configuration.

When using this configuration, interference between the sleeve 5511*d* and the heat dissipation pipe 552 may be prevented during the process of stacking the fins 5511, 5513 and 5515 above the second pipe 552*b* of the heat dissipation pipe such that the fins pass through the second pipe 552*b*.

That is, since the heat dissipation pipe 552 passes through the pipe through-hole 5511*c* and then passes through the sleeve 5511*d*, the heat dissipation pipe 552 may be prevented from interfering with the sleeve 5511*d*.

Thus, an upper fin of two vertically adjacent fins may be seated on the sleeve 5511*d* of a lower fin.

In addition, each of the first to third fins 5511, 5513 and 5515 may commonly include spacers 5511*a* and 5511*b* that are bent from each of the fins 5511, 5513 and 5515 and extend in the upward direction.

The spacers 5511*a* and 5511*b* may be extended from each of the two long sides 5511*f* and 5511*g* of each of the fins 5511, 5513 and 5515.

Furthermore, a plurality of spacers 5511*a* and 5511*b* may be formed on each of the long sides 5511*f* and 5511*g* of each of the fins 5511, 5513 and 5515 such that the vertical spacing between the fins may be kept constant in a length direction of the fin (horizontal direction in the figure).

In the present embodiment, a total area or total length of the first spacers 5511*a* formed on a first long side 5511*f*, which is positioned closer to the heat dissipation plate 553, among the long sides 5511*f* and 5511*g* of each of the fins 5511, 5513 and 5515 may be larger than a total area or total length of the second spacers 5511*b* formed on a second long side 5511*g*, which is positioned opposite the first long side 5511*f*, among the long sides 5511*f* and 5511*g* of each of the fins 5511, 5513 and 5515.

Thus, since the second long side 5511*g* is located closer to the heat dissipation fan 590, the second spacer 5511*b* positioned on the second long side 5511*g* may minimally resist the flow of air as blown by the heat dissipation fan 590.

In particular, the second spacer 5511*b*, positioned on the second long side 5511*g*, does not overlap with the sleeve 5511*d* in the front-rear direction (the arrangement direction between the first long side and the second long side).

Thus, when air flows toward the sleeve 5511*d*, the second spacer 5511*b* provided on the second long side 5511*g* may be prevented from interrupting the flow of air.

Additionally, each of the first to third fins 5511, 5513 and 5515 may include an engagement groove 5511*e* for the fin-engagement portion 5530 to be fitted therewith. The engagement groove 5511*e* may be formed on the first long side 5511*f*.

In one embodiment, the first fin 5511 may further include a first groove 5512 to form the fin-engagement portions 540 and 542. The first groove 5512 may extend from the second long side 5511*g* toward the first long side 5511*f*.

The second fin 5511 may further include a second groove 5514 to form the fin-engagement portions 540 and 542. The second groove 5514 may extend from the second long side 5511*g* toward the first long side 5511*f*.

The second groove 5514 may include a neck 5514*a* that is reduced in size. The width of the neck 5514*a* may be smaller than the diameter of the second portion 583 of the head 581.

The neck 5514*a* may be located on the second long side 5511*g*.

The size or area of the second groove 5514 may be smaller than the size or area of the first groove 5512.

When joining the heads 581 of the fixing pins 580 to the fin-engagement portions 540 and 542, the first portion 582 may move in the first groove 5512, while the second portion 583 may be accommodated in the second groove 5514. Further, the extension 584 may be located in the neck 5514*a*.

Thus, the second portion 583 of the head 581 located in the second groove 5514 may be prevented from being separated from the heat dissipation fin 551 due to the presence of the neck 5514*a*.

A plurality of the first fins 5511, each having the first groove 5512, may be stacked in a vertical direction. A plurality of the second fins 5513, each having the second groove 5514, may be stacked under the plurality of the first fins 5511. The present disclosure is not limited to the above-described configuration.

In the third fin 5515, the first groove 5512 and the second groove 5514 are not formed.

The heat dissipation fin 551 may additionally include fourth to sixth fins 5516, 5517 and 5518, each having a shorter horizontal length than that of each of the first to third fins 5511, 5513 and 5515.

Each of the fourth to sixth fins 5516, 5517 and 5518 may also basically include the spacers 5511*a* and 5511*b*, the sleeve 5511*d* and the pipe through-hole 5511*c*.

Hereinafter, the assembly process between the heat dissipation fin and the heat dissipation plate and the heat dissipation pipe will be described.

First, in a state in which the plurality of heat dissipation pipes 552 are arranged in the horizontal direction, the plurality of fins may be sequentially stacked while being coupled with the heat dissipation pipes 552.

For example, a plurality of the third fins 5515 may be stacked as the lowermost layer. Then, a plurality of the second fins 5513 may be stacked on top of the third fins 5515. Then, the plurality of the first fins 5511 may be stacked on top of the second fins 5511.

While, in this state, a plurality of the fourth fins 5516, a plurality of the fifth fins 5517, and a plurality of the sixth fins 5518 are arranged in the horizontal direction on the top the stack of the first fins 5511, the plurality of the fourth fins 5516, the plurality of the fifth fins 5517, and the plurality of the sixth fins 5518 may be stacked in the vertical direction on the top the stack of the first fins 5511.

For example, the first heat dissipation pipe 5522*a* among the plurality of heat dissipation pipes 552 may penetrate the stack of the fourth fins 5516. Further, while the stack of the fifth fins 5517 is separated from the stack of the fourth fins 5516, the third pipe 5522*c* among the plurality of heat dissipation pipes 552 may penetrate through the stack of the fifth fins 5517.

In this case, since the stack of fourth fins 5516 and the stack of fifth fins 5517 are spaced from each other in the horizontal direction, the second heat dissipation pipe 5522*b* among the plurality of heat dissipation pipes 552 is disposed between the stack of fourth fins 5516 and the stack of fifth fins 5517. In this way, the fastener 5519 for engaging the heat dissipation plate 553 with the thermal-insulating member 570 and the cooling plate 531 may be positioned in the space between the stack of fourth fins 5516 and the stack of fifth fins 5517.

In one example, the fastener 5519 sequentially penetrates the heat dissipation plate 553, the thermal-insulating member 570, and the cooling plate 531. Then, at the cooling plate 531, a nut may be engaged with the fastener 5519.

Conversely, the fastener 5519 may sequentially penetrate the cooling plate 531, the thermal-insulating member 570, and the heat dissipation plate 553.

Further, the fifth heat dissipation pipe 5522*e* among the plurality of heat dissipation pipes 552 may penetrate the stack of the sixth fins 5518 which is spaced from the stack of the fifth fins 5517.

In this case, since the stack of sixth fins 5518 and the stack of fifth fins 5517 are spaced from each other in the horizontal direction, the fourth heat dissipation pipe 5522*d* among the plurality of heat dissipation pipes 552 is disposed between the stack of sixth fins 5518 and the stack of fifth fins 5517. In this way, the fastener 5519 for engaging the heat dissipation plate 553 with the thermal-insulating member 570 and the cooling plate 531 may be positioned in the space between the stack of sixth fins 5518 and the stack of fifth fins 5517.

That is, the stack of sixth fins 5518, the stack of fifth fins 5517 and the stack of fourth fins 5516 may be spaced apart from each other in a direction intersecting the stacking direction of the plurality of fins.

The number of fins in the stack of sixth fins 5518, the number of fins in the stack of fifth fins 5517 and the number of fins in the stack of fourth fins 5516 may be same. After the stack of sixth fins 5518, the stack of fifth fins 5517 and the stack of fourth fins 5516 are formed, the stack of the third fins 5515 may be further formed on the stack of sixth fins 5518, the stack of fifth fins 5517 and the stack of fourth fins 5516.

Thereafter, the stack of the second fins 5513 may be further formed on the stack of third fins 5515. Then, the stack of the first fins 5511 may be further formed on the stack of second fins 5513.

Thus, the heat dissipation plate 553 may be bonded to the plurality of the stacked fins in the state in which the stacking of the plurality of fins has been completed. In one example, the heat dissipation plate 553 may be positioned above the plurality of fins and may be moved downward thereon such that the fin-engagement portion 5530 is slidably inserted into the engagement groove 5511*e* in each fin.

Then, after seating each heat dissipation pipe 552 into the pipe-seated groove 5533 in the heat dissipation plate 553, the element contacting plate 554 may be bonded to the heat dissipation plate 553.

According to the proposed invention, not only the heat dissipation fin directly contacts with the heat dissipation plate but also the heat dissipation pipe connects the heat dissipation fin and the heat dissipation plate. Thus, the heat dissipation performance of the heat sink may be improved.

In addition, in a state in which the plurality of the fins has been stacked, the fin-engagement portion of the heat dissipation plate may be slidably coupled to the engagement groove in each fin. Thus, the heat dissipation plate and the heat dissipation fin can be easily combined.

Furthermore, since the plurality of fins are brought into contact with the heat dissipation plate, the plurality of fins is prevented from moving in one direction. Since the plurality of heat dissipation plates penetrate the heat dissipation fin, the horizontal direction movement of the plural fins is prevented. Thus, an additional structure for fixing the position of the fins may be unnecessary.

In addition, since the receiving groove for receiving the heat dissipation pipe is formed in each of the heat dissipation plate and the element contacting plate, the thickness of the thermoelectric module may be prevented from increasing due to the presence of the heat dissipation pipe. Further, a contact area between the heat dissipation pipe and the element-mounted plate, and a contact area between the heat dissipation pipe and the heat dissipation plate are increased, thereby improving the heat dissipation performance.

What is claimed is:

1. A refrigerator comprising:

an inner casing having a storage chamber defined therein; and a thermoelectric module comprising (i) a thermoelectric element that is configured to cool the storage chamber, (ii) a cooling sink that is configured to contact a first surface of the thermoelectric element, and (iii) a heat sink that is configured to contact a second surface of the thermoelectric element, wherein the heat sink of the thermoelectric module comprises:

a heat dissipation fin comprising a stack of a plurality of fins, a heat dissipation plate that is coupled to the heat dissipation fin, and at least one heat dissipation pipe that connects the heat dissipation plate to the heat dissipation fin and that passes through the heat dissipation fin, wherein the heat dissipation plate has a first surface that is in contact with the at least one heat dissipation pipe, wherein the heat dissipation plate comprises a fin-engagement portion that is disposed at a second surface of the heat dissipation plate opposite to the first surface, that extends along a stacking direction of the stack of the plurality of fins, and that is engaged with the heat dissipation fin, and wherein at least one of the plurality of fins has an engagement groove engaged with the fin-engagement portion.

2. The refrigerator of claim 1, wherein the first surface of the heat dissipation plate has at least one pipe-seated groove that receives the at least one heat dissipation pipe.

3. The refrigerator of claim 2, wherein the heat sink of the thermoelectric module further comprises an element contacting plate that is configured to contact the thermoelectric element, wherein the element contacting plate has at least one groove that is configured to receive the at least one heat dissipation pipe, and wherein the element contacting plate is configured to surface-contact the first surface of the heat dissipation plate.

4. The refrigerator of claim 2, wherein the at least one heat dissipation pipe of the heat sink of the thermoelectric module comprises a plurality of heat dissipation pipes, wherein the plurality of heat dissipation pipes connects the heat dissipation plate to the heat dissipation fin in a state in which the plurality of heat dissipation pipes is spaced from each other.

5. The refrigerator of claim 2, wherein the at least one heat dissipation pipe comprises:

a first pipe that is configured to contact the heat dissipation plate;

a second pipe that is configured to pass through the heat dissipation fin; and a third pipe that has a bent shape and that is configured to connect the first pipe and the second pipe.

6. The refrigerator of claim 1, wherein the fin-engagement portion of the heat dissipation plate comprises a first protrusion and a second protrusion that are spaced apart from each other in a direction perpendicular to the stacking direction of the stack of the plurality of fins, and wherein the first protrusion and the second protrusion are received together in the engagement groove of the plurality of fins.

7. The refrigerator of claim 6, wherein a width of the engagement groove of the plurality of fins is less than or equal to a maximum distance between the first protrusion and the second protrusion of the fin-engagement portion of the heat dissipation plate.

8. The refrigerator of claim 1, wherein at least one of the plurality of fins comprises:

at least one pipe through-hole through which the at least one heat dissipation pipe is configured to pass through, and a sleeve that is configured to extend around the at least one pipe through-hole.

9. The refrigerator of claim 8, wherein the at least one heat dissipation pipe is configured to pass through the at least one pipe through-hole in a first direction, and wherein the sleeve is configured to protrude in the first direction around the at least one pipe through-hole.

10. The refrigerator of claim 1, wherein each of the plurality of fins comprises a spacer that is configured to define a spacing between the plurality of fins.

11. The refrigerator of claim 10, wherein at least one of the plurality of fins comprises a pair of long sides and a pair of short sides, and wherein each of the pair of long sides has a plurality of spacers that are spaced from one another.

12. The refrigerator of claim 11, wherein the pair of long sides comprises (i) a first long side that is positioned adjacent to the heat dissipation plate, and (ii) a second long side that is positioned opposite the first long side, and wherein a total area or a total length of second spacers formed on the second long side is smaller than a total area or a total length of first spacers formed on the first long side.

13. The refrigerator of claim 1, wherein the refrigerator further comprises:

a fixing pin that is configured to couple to the heat dissipation fin of the heat sink of the thermoelectric module; and a heat dissipation fan that is configured to couple to the fixing pin, wherein at least one of the plurality of fins has a pin-engagement portion with which the fixing pin is configured to engage.

14. The refrigerator of claim 1, wherein the heat sink and the cooling sink of the thermoelectric module are configured to be fastened with each other via a fastener, and wherein at least two fins among the plurality of fins are spaced apart from each other in a direction intersecting the stacking direction of the stack of the plurality of fins such that the fastener is configured to be positioned in a spacing between the at least two fins.

15. The refrigerator of claim 1, wherein the fin-engagement portion of the heat dissipation plate comprises a protrusion that protrudes to the plurality of fins, that passes through at least a portion of the plurality of fins in the stacking direction, and that is received in the engagement groove.

16. The refrigerator of claim 1, wherein the fin-engagement portion of the heat dissipation plate is one of a plurality of fin-engagement portions that are spaced apart from one another in a direction perpendicular to the stacking direction, and wherein each of the plurality of fin-engagement portions comprises a first protrusion and a second protrusion that are spaced apart from each other in the direction perpendicular to the stacking direction and that are received together in the engagement groove of the plurality of fins.

17. The refrigerator of claim 1, wherein the heat dissipation plate is located between the heat dissipation fin and the at least one heat dissipation pipe, and wherein the second surface of the heat dissipation plate is in contact with the plurality of fins.

18. The refrigerator of claim 1, further comprising a heat dissipation fan that faces the heat dissipation fin, wherein the heat dissipation fin is located between the heat dissipation plate and the heat dissipation fan.

19. The refrigerator of claim 1, wherein the engagement groove is recessed from surfaces of the plurality of fins facing the second surface of the heat dissipation plate and extends along the stacking direction.

* * * * *